United States Patent [19]

Littmann

[11] Patent Number: 4,628,836

[45] Date of Patent: Dec. 16, 1986

[54] PROCESS FOR INHIBITING CORROSION AND MINIMIZING DEPOSITS IN AN AIR PREHEATER SYSTEM

[75] Inventor: Robert J. Littmann, Westfield, N.J.

[73] Assignee: Waterscience, Inc., Somerville, N.J.

[21] Appl. No.: 644,312

[22] Filed: Aug. 24, 1984

[51] Int. Cl.[4] ..... F23J 7/00

[52] U.S. Cl. ..... 110/343; 110/302; 110/345; 203/7; 208/47; 252/392

[58] Field of Search ..... 110/254, 301–304, 110/342–345; 122/4 D; 422/9, 10; 252/392; 423/242–244; 208/47; 203/7; 44/51

[56] References Cited

U.S. PATENT DOCUMENTS

| | | | |
|---|---|---|---|
| 4,130,524 | 12/1978 | Boerwinkle et al. | 252/392 X |
| 4,168,291 | 9/1979 | Libutti et al. | 422/9 |
| 4,206,172 | 6/1980 | Sujdak | 252/392 X |
| 4,245,573 | 1/1981 | Dixit et al. | 110/345 X |
| 4,352,747 | 10/1982 | Every et al. | 110/345 X |
| 4,412,844 | 11/1983 | Collins et al. | 44/51 |
| 4,428,866 | 1/1984 | Every et al. | 110/345 X |
| 4,496,525 | 1/1985 | Albanese | 110/343 X |
| 4,504,275 | 3/1985 | Baker | 44/51 |
| 4,512,774 | 4/1985 | Myers et al. | 44/51 |

*Primary Examiner*—Albert J. Makay
*Assistant Examiner*—Steven E. Warner
*Attorney, Agent, or Firm*—Lerner, David, Littenberg, Krumholz & Mentlik

[57] ABSTRACT

A process is disclosed for inhibiting corrosion of metal surfaces and deposition of particulates in an air preheater system. In the process, a composition (preferably aqueous) comprising a corrosion inhibiting amine and a surfactant having an HLB value of from about 8 to about 20, preferably from about 10 to about 14, is supplied to the combustion gas-in side and/or to the air-in side of the air preheater for protection of the metal surfaces and minimizing such deposits. In a preferred embodiment, the process of the invention can employ an amine salt of a $C_{12}$ to $C_{24}$ tertiary alkyl amine an amine oxide, or an amine oxide salt, either alone or with a surfactant.

27 Claims, 5 Drawing Figures

PROCESS FOR INHIBITING CORROSION AND MINIMIZING DEPOSITS IN AN AIR PREHEATER SYSTEM

BACKGROUND OF THE INVENTION

The present invention relates to a process for inhibiting corrosion of metal surfaces and minimizing deposits in an air preheater system. More specifically, the present invention relates to a process in which a corrosion inhibiting and antifouling composition is supplied to the air preheater system.

The combustion gases of fuel fired vessels contain various contaminants or combustion by-products which can cause corrosion of system metals when condensed in the cold end of the system, i.e. when the temperature drops below the dew point. Moreover, solids can deposit which can also cause gas flow restrictions in the air heater.

Typical corrosive agents are $H_2CO_3$ produced in the combustion of carbon and $H_2SO_4$ from $SO_3$ produced in the combustion of sulfur. As the flue gases pass through the boiler heat exchange system, heat is extracted with consequent cooling occurring. As the dew point of the gas is reached, condensing of these corrosive agents into an aqueous solution occurs. The condensed weak and strong acids corrode boiler system metals-typically, economizers, air heaters, ducts, electrostatic precipitators, stacks, etc. The wet, sticky mass which accumulates in itself is a foulant but also causes entrapment or adhesion of particulates from the flue gas. The corrosion and fouling which occur affect the reliability of the fuel fired unit, reduce efficiency of heat transfer in the energy recovery equipment, cause forced outages, reduce the megawatt output of the unit (deration), increase maintenance costs, and reduce equipment life.

Various techniques, have been employed in attempt to prevent corrosion and inhibit deposition in air preheater systems, i.e., at the cold end of boiler combustion systems. One method maintains the exit gas temperature above the dew point. This method, however, causes loss of usable energy.

Another method involves disassembling of the cold end components, cleaning them of deposits and replacing deteriorated materials as required. This method also causes loss of usable energy due to fouling. In addition, there is considerable down time and the equipment life is reduced.

In another process inorganic powders such as magnesium oxide, sodium aluminate and the like are added, for example, to flue gases from a boiler. These inorganic powders react with the acidic materials in the flue gases, which are primarily $H_2CO_3$ and $H_2SO_4$ from the carbon dioxide, sulfur dioxide and sulfur trioxide in the flue gases. These powders are added in proportion to the concentration of such materials to cause a neutralization reaction in which the $H_2CO_3$ and $H_2SO_4$ are removed as solid materials.

The processes employing inorganic powders, however, have a number of disadvantages. They employ a stoichiometric amount of the powder relative to the amount of the acid material in the gas stream. Also, the reaction product between the acid in the gas stream and the inorganic powder is a solid which can cause fouling of the air preheater, especially when the air heater metal temperature is below the water dew point. Moreover, the inorganic powders are not distributed very well over the air preheater surfaces, because they are powders. In addition, these powders require chemical powder feed equipment, which is costly to purchase and install and to maintain. Still further, the inorganic powders increase the amount of particulate matter that a downstream particulate collector must remove.

Others have employed neutralizing amines as cold-end additives. For example, U.S. Pat. Nos. 4,134,728, 4,134,729, 4,185,071 and 4,206,172 disclose the use of alkanolamines and ethylene polyamines as such cold-end additives, either alone or in combination with each other or in combination with sodium aluminate. The effectiveness of these amines as corrosion inhibitors are, however, relatively limited. The amount of amine added is directly related to the acid content of the combustion stream to be treated and therefore requires a relatively large amount of amine for such processes. Moreover, the amines provide relatively unstable formulations with water and therefore cannot be stored over a wide range of temperatures over long periods of time without difficulty. The amines typically form dispersions in water.

SUMMARY OF THE INVENTION

It has now been found that a process for inhibiting corrosion of metal surfaces and inhibiting deposits in an air preheater system can be provided in which a composition comprising a corrosion inhibiting amine and a surfactant having an HLB value of from about 8 to about 20, preferably from about 10 to about 14, is supplied to the air preheater system. In one preferred embodiment, the amine is in a salt form. The composition is preferably an aqueous system.

In the process of the invention, the composition can be supplied at various points in the cold-end of a boiler system, e.g., to the combustion gas-in side of the preheater upstream of the preheater, to the air-in side of the air preheater, or via a soot blower for the preheater. With coal fired units which generate high amounts of particulates in the flue gases, it is preferred to supply the composition to the air-in side of the air preheater to avoid deposition of the composition on particulates.

The combination of the corrosion inhibiting amine and the surfactant has surprisingly been found to provide excellent corrosion inhibition of heated metal surfaces and also antifouling characteristics. These results are obtained, moreover, with a lower rate of application of the amine. The surfactant has surprisingly been found to enhance the corrosion inhibiting and antifouling effects of the amine and to therefore require less amine in the treating composition than with compositions employing amine alone without the surfactant, thus making the process economically advantageous. This effect with the surfactant is even more surprising, since the surfactant would be expected to increase the wetability of the metal surfaces and therefore perhaps even increase corrosion by the acidic materials condensed from flue gases in the cold end of the system.

Moreover, it has been found that the amount of the composition supplied to the system need not be stoichiometrically related to the amount of acidic materials in the flue gases. Rather, it has been found that all that is required is to supply a sufficient amount of the composition to coat the desired metal surfaces to be protected. Thus, even intermittent application of the composition can be employed.

The process of the invention provides a number of other significant advantages. In particular, the combination of the corrosion inhibiting amine and the surfactant having an HLB value of from about 8 to about 20 provides a more stable formulation, i.e., the amine is dispersed in the composition as a stable emulsion or is dissolved in the composition. Therefore, the composition can be stored over a wider range of temperatures for a longer period of time without difficulty. Moreover, the inclusion of the surfactant in the composition provides better dispersion and/or solution of the corrosion inhibiting amine in the composition, which is normally aqueous. This better dispersion provides a better distribution of the product when injected to the air preheater system than obtained with the amines by themselves. Thus, more uniform coating of metal surfaces is obtained. The treatment with the combination of the corrosion inhibiting amine and the surfactant may also be used for defouling of air preheaters.

Still further, the process of the invention also has a number of significant advantages over the prior art techniques employing inorganic powders. Again, the amount of the composition employed in the process of the invention is related to the surface area to be treated, not relative to the amount of acidic materials in the gas stream as with the techniques employing inorganic powders. Also, there is less fouling of the air heater caused by the treating composition itself. Moreover, the composition employed in the process of the invention is distributed more uniformly over air heater surfaces than with such inorganic powders and does not require chemical powder feed equipment, which equipment is relatively costly to purchase, install and maintain.

In another embodiment of the invention, the inhibition of corrosion of metal surfaces and minimizing of deposits in the air preheater is accomplished by supplying to the air preheater system a composition comprising an amine selected from a $C_{12}$ to $C_{24}$ tertiary alkyl amine salt or an amine oxide or salt thereof, either alone or with a surfactant. Again, such an amine can be added at various points in the system as discussed above and in further detail below. This process of the invention employing a $C_{12}$ to $C_{24}$ tertiary alkyl amine salt, amine oxide, or amine oxide salt has been found to provide particularly advantageous corrosion inhibiting and antifouling characteristics, especially when used in combination with a surfactant as discussed above.

In one other aspect of the invention, a process is provided for preparing a composition for treating metal surfaces in an air preheater system to inhibit corrosion and to minimize deposits. In this process, a corrosion inhibiting amine is reacted with an acid which will form a salt of the amine. The salt is mixed with water and a surfactant in an sufficient amount to provide a stable solution of the amine salt in the water.

DETAILED DESCRIPTION OF THE INVENTION

Figure 1:
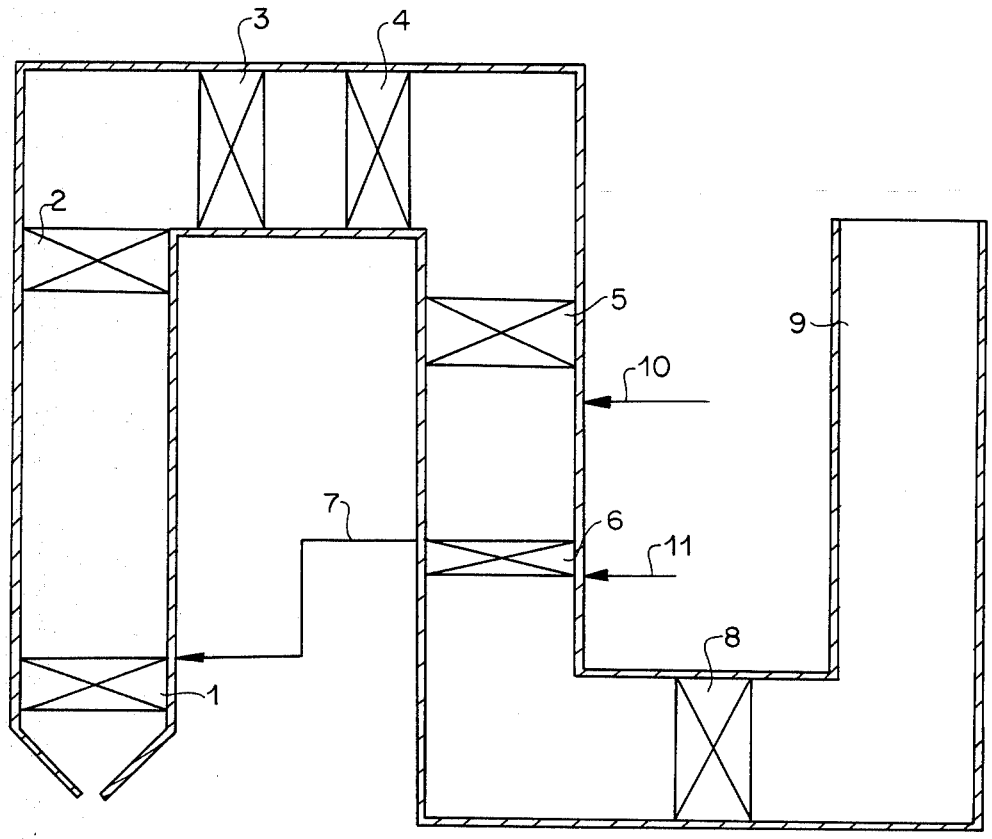
FIG. 1 illustrates in schematic form the various points at which the corrosion inhibiting and antifouling composition can be applied in accordance with the process of the invention.

In the process of the invention, a composition is supplied to an air preheater system to inhibit corrosion of the metal surfaces and to inhibit deposits therein from the combustion gases. The composition comprises a corrosion inhibiting amine and a surfactant having an HLB value of from about 8 to about 20, preferably from about 10 to about 14. A sufficient amount of the composition is supplied to coat the desired metal surfaces to provide the desired corrosion and deposit inhibition.

The composition can be supplied to the combustion system at various points so as to provide protection for the air preheater system and for other parts of the combustion system downstream of the air preheater. The composition can be supplied to the combustion gas-in side of the air preheater system upstream of the air preheater, e.g. after the economizer, to the air-in side of the air preheater, via a soot blower for cleaning of the air preheater or combinations thereof. With coal-fired combustion units, it is preferred to supply the composition to the air-in side of the preheater so as to avoid deposition of the composition on particulates in the flue gases during application of the composition. The composition of the invention may also be supplied via the soot blower as a defouling composition for cleaning of the air preheater, preferably when the unit is in operation.

Because the process of the invention is not necessarily related to an attempt to neutralize acidic materials in the combustion gas stream to prevent corrosion, the composition need not be supplied continuously. Rather, the composition in the process of the invention can be supplied intermittently as needed only to form a film on the surface of the metal to be protected and to maintain such films.

Any corrosion inhibiting amine can be employed in the process of the invention. Suitable corrosion inhibiting amines include primary, secondary and tertiary aliphatic or aromatic amines or derivatives thereof. Preferably, the corrosion inhibiting amine is in the form of a salt. Typical corrosion inhibiting amines include amine oxides, imidazolines, tertiary alkyl amines, secondary alkyl amines, primary alkyl amines, hydroxylated primary and secondary alkyl amines, salts of the foregoing amines, and mixtures of such amines or salts. Some amines that can be employed in the process of the invention include alkyl dimethyl amine oxide such as lauryl dimethyl amine oxide, lower alkylamidopropyl dimethyl amine oxide, and lower alkyl-bis-hydroxyethyl amine oxide; 1-hydroxyethyl-2-octadecylimidazoline; a $C_{12}$–$C_{24}$ tertiary alkyl amine salt (i.e., a compound in which the amine nitrogen is attached to a tertiary carbon of the alkyl group) such as 7-pentyl-7-pentadecyl ammonium sulfate or 4-propyl-4-decyl ammonium sulfate; dodecyl amine; di(hydrogenated tallow)amine; and $RN(CH_2CH_2OH)(CH_3)_2N(CH_2CH_2OH)_2$ where R is tallow.

Surfactants having an HLB value of from about 8 to about 20, preferably from about 10 to about 14, can be employed in the present invention. Suitable surfactants include alkanolamides, block copolymers of ethylene oxide and propylene oxide, ethoxylated alcohols, ethoxylated alkyl phenols, and mixtures thereof. Some examples of specific surfactants include coconut fatty acid amide of diethanolamine, a block copolymer of propylene oxide and ethylene oxide on a propylene glycol base with a molecular weight of the propylene oxide portion of 1750 and an ethylene oxide content of about 40%, octyl phenol ethoxylated with 10 moles of ethylene oxide, and a linear or secondary alcohol ethoxylated with 7 mols of ethylene oxide.

The composition employed in the process of the invention is suitably an aqueous solution or dispersion containing the corrosion inhibiting amine and the surfactant. Many times the surfactant acts to provide a better dispersion of the amine in the aqueous solution. Other solvents can also be employed where appropriate.

The composition of the invention suitably contains the corrosion inhibiting amine and the surfactant in a weight ratio of from about 20:1 to about 1:10, respectively. Preferably, the weight ratio of the corrosion inhibiting amine to the surfactant is from about 5:2 to about 1:3 by weight.

The concentration of the amine and surfactant in the composition employed in the process of the invention can vary greatly. Typically, the concentration of the corrosion inhibiting amine is from about 2% to about 20% and the concentration of the surfactant is from about 2% to about 20%.

The rate of application of the composition again varies greatly depending on the conditions of the fuel being combusted, the equipment being employed, etc. An effective amount of the composition is employed to provide the corrosion inhibition and to minimize or inhibit deposition. As a typical example, in a 600 megawatt boiler about 50 gallons per day of a composition containing about 10% by weight of 7-pentyl-7-pentadecyl-ammonium sulfate and about 4% by weight alkyleneoxy-ethylenoxy ethanol [$C_{12}H_{29}O$-(-$CH_2CH_2O$)$_7CH_2CH_2OH$] in water can be employed.

In another embodiment of the invention, the inhibiting of the corrosion of the metal surfaces and the minimizing of deposits in the air preheater system is accomplished by using a composition comprising a $C_{12}$ to $C_{24}$ tertiary alkyl amine salt or an amine oxide or salt thereof. The terminology tertiary alyl amine salts is intended to include compounds which in the amine nitrogen is attached to a tertiary carbon of the alkyl group. Because of the properties of such amines or amine oxides, they can be employed without the necessity for also including a surfactant. However, it is preferable to also include a surfactant as discussed above, even when employing such preferred amine salts or amine oxides in the process of the invention. Suitable amine salts or amine oxides of this class include 7-pentyl-7-pentadecylammonium sulfate [$(C_{20}H_{41}—NH_3^+)_2SO_4^=$], 4-propyl-4-decylammonium sulfate [$(C_{13}H_{27}—NH_3^+)_2SO^=_4$], coco-dimethylamine oxide, lower alkylamidopropyl dimethylamine oxide, lower alkyl-bis-hydroxyethyl amine oxide and salts of such amine oxides.

The compositions employed in the present invention can be supplied to the flue gases, e.g., after the economizer. In addition, the composition can be supplied to the air-in side of the preheater, especially with coal-fired units where the particulates in the flue gases are relatively high and the composition could therefore deposit on the particulates during the application of the composition in the process of the invention. This is particularly true, since protection of surfaces rather than neutralization of acid material in the combustion gas is the primary purpose of the invention.

The rate of application of the composition in the process of the invention can vary depending, for example, on the size of the unit being treated. Preferably, the composition is applied at a rate sufficient to reduce the corrosion rate by a factor of at least about 2, more preferably, at least about 4. For example, to reduce the corrosion rate by a factor of 5 for a 300 megawatt unit, 2 gal./hr. of one composition in accordance with the invention was employed.

The compositions employed in the invention can be prepared by, for example, mixing the corrosion inhibiting amine in an aqueous solution containing a suitable surfactant as discussed above. Preferably, the composition is a stable solution or dispersion of the amine, i.e., solution as dispersion from which the amine will not separate for at least about six months, preferably at least about one year under storage conditions.

In a preferred embodiment of the invention, a corrosion inhibiting amine is reacted with an acid which forms the salt of the amine. This salt is mixed with water and a surfactant in a sufficient amount to provide a stable solution or dispersion of the amine salt in the water. This latter embodiment has been found to provide compositions for use in the present invention which are stable over long periods of time, e.g., more than about 9 months.

In FIG. 1, a combustion system is illustrated in which the numeral 1 represents the combustion chamber where the fuel such as oil, gas or coal is combusted. Block 2 represents a superheater for steam generation. Blocks 3 and 4 represent the reheat section. Water for generation of steam is normally supplied so that it runs countercurrent to the combustion gas flow and is last heated in superheater 2 to achieve its final desired temperature. Block 5 represents an economizer as is conventional in the art. Block 6 represents the air preheater in which air is supplied to the air-in side of the air preheater to preheat the air which is supplied for combustion of the fuel in combustion zone 1, via for example line 7. The cooled combustion gases then pass through a precipitator 8 and out the stack 9.

The composition employed in the process of the invention can be supplied to the system at various points. For example, the composition can be supplied, for example, at point 10 after the economizer or at point 11 with the air to be preheated to the air-in side of the air preheater or combinations thereof. The composition can be supplied via conventional spray or atomizing nozzles or via the soot blower for the air preheater. In this latter regard, the process of the invention may be used as a defouling composition in the cleaning of the air preheater or can be used during operation to provide the corrosion and deposit inhibition.

The following examples are intended to illustrate, but not to limit, the process of the invention. EXAMPLE 1

A series of laboratory tests were conducted to compare the corrosion protection afforded to a test coupon by the invention and other corrosion protection treatments.

A series of 11 pre-weighed mild steel corrosion coupons were immersed into a solution of 2% (W/W) aqueous sulfuric acid in sealed glass containers. The containers were heated in an oven to 150° F. Four compositions were prepared with four corrosion inhibiting amines, namely, 4-propyl-4-decylammonium sulfate [$(C_{13}H_{27}—NH_3^+)_2SO_4^{-2}$] (A in Table 1 below); 7-pentyl-7-pentadecylammonium sulfate [$(C_{20}H_{41}—NH_3^+)_2SO_4^{-2}$] (B in Table 1 below);

Ethoduomeen T-13 [$RN(CH_2CH_2OH)(CH_3)_2N(CH_2CH_2OH)_2$ where R is tallow—available from Armak] (C in Table 1 below); and coco-dimethylamine oxide [$(C_{12}H_{25}N(CH_3)_2O$] (D in Table 1 below); respectively. Four other compositions were prepared with the same corrosion inhibiting amines with alkyleneoxypolyethylenoxy ethanol [$C_{12}H_{29}O(CH_2CH_2O)_7CH_2CH_2OH$] as a surfactant. Where the amines were employed alone, their concentration was 100 ppm. Three further compositions were prepared employing the salt of such amines (D was not prepared) in combination with the same surfactant. In each instance where a combination of amine and surfactant was employed, the weight ratio of the amine to the surfactant was about 3:1. The concentration of the amine and surfactant was about 75 ppm and 25 ppm., respectively. These corrosion inhibiting compositions were thus added to the acid solutions at an overall concentration of 100 ppm. After one or two days, each corrosion coupon's weight loss was determined and the corrosion rate data was determined as a ratio of the blank corrosion rate versus the treated corrosion rate. The results are as set forth below in Table 1.

TABLE 1

| Amine Employed | Rate With: Corrosion Inhibiting Amine (CIA) | CIA + Surfactant | Acidified CIA + Surfactant |
|---|---|---|---|
| A | 1 | 1.3 | 1.4 |
| B | 1.6 | 4.2 | 10.3 |
| C | 1.9 | 2.1 | 2.8 |
| D | 2.4 | 3.0 | — |

[1]Not prepared.

EXAMPLE 2

The process of the invention employing an aqueous composition including 10% by weight 4-propyl-4-decylammonium sulfate, 4% by weight alkyleneoxypolyethylenoxy ethanol [$C_{12}H_{29}O(CH_2CH_2O)_7—CH_2CH_2OH$] was used to afford corrosion protection to the air heaters on a 320 megawatt Foster Wheeler Utility Boiler. This composition was supplied to the combustion gas-in side of the air heater at a rate of from 1 to 6 gallons/hour. A comparison was made between one air heater treated with the invention and another air heater on the same unit untreated. The results were as set forth below in Table 2.

TABLE 2

| Time Period | Untreated: Corrosion Readings | Mils Per Year | Treated: Corrosion Readings | Mils Per Year | Ratio |
|---|---|---|---|---|---|
| 38 days | 83–50 | 6.44 | 85–90 | 0.48 | 13.4/1 |
| 50 days | 150–270 | 13.69 | 90–110 | 2.28 | 6.0/1 |
| 12 days | 270–374 | 30.42 | 110–135 | 7.60 | 4.0/1 |
| 100 days | 83–374 | 12.78 | 85–135 | 2.22 | 5.76/1 |

EXAMPLE 3

Figure 2A:
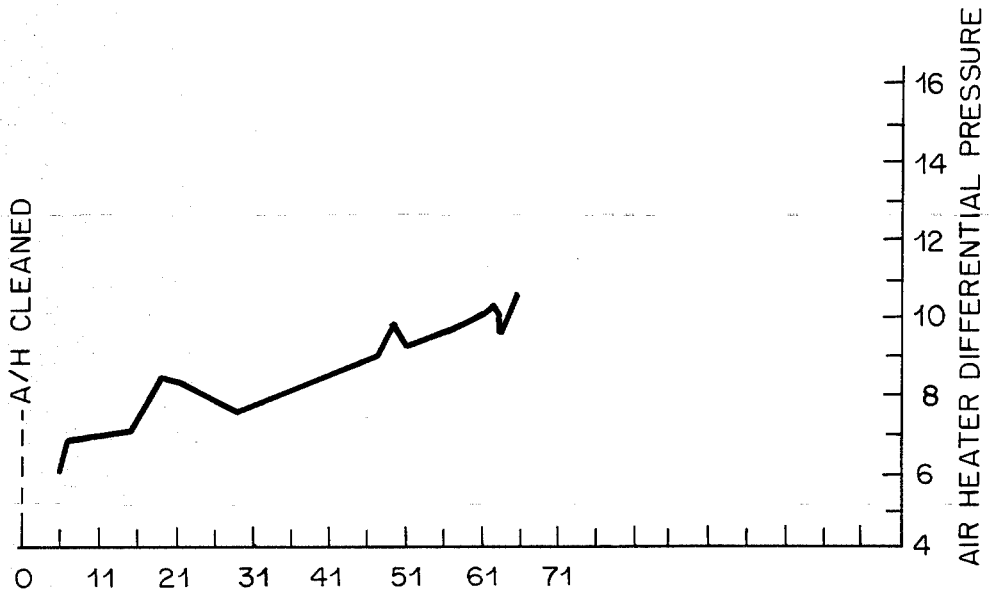
FIG. 2 is a graphical representation illustrating a comparison of the results obtained with the invention (FIG. 2*a*) vis-a-vis the results obtained employing MgO powder (FIG. 2*b*).
Figure 2B:
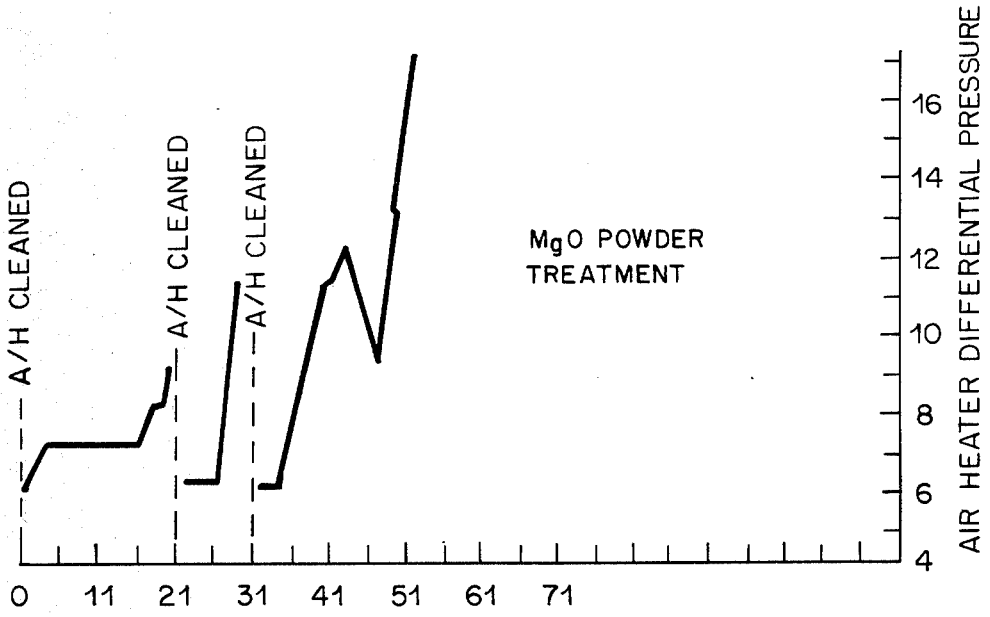
Figure 3A:
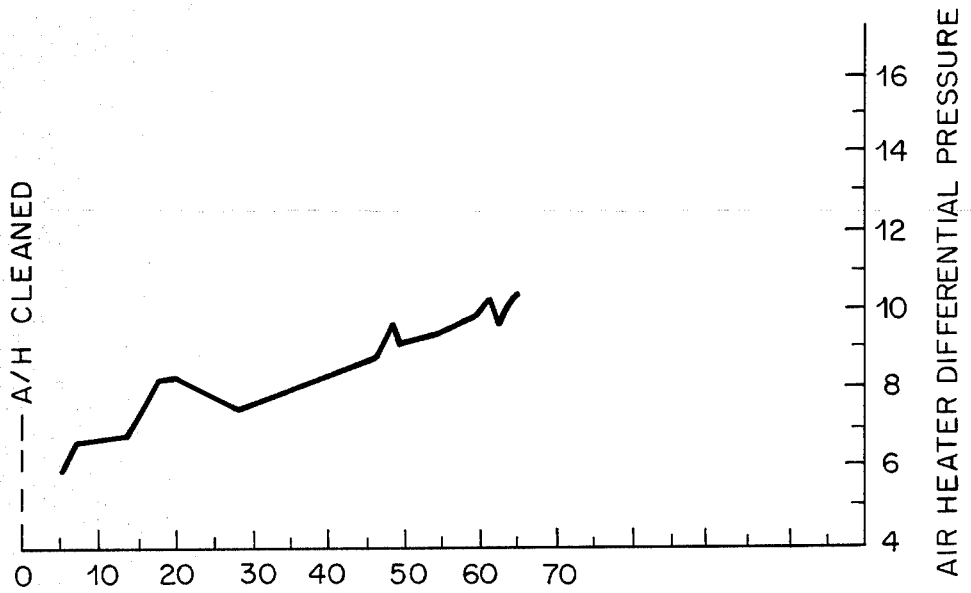
FIG. 3 is a graphical representation illustrating a comparison of the results obtained with the invention (FIG. 3*a*) vis-a-vis the results obtained employing sodium aluminate (FIG. 3*b*).
Figure 3B:
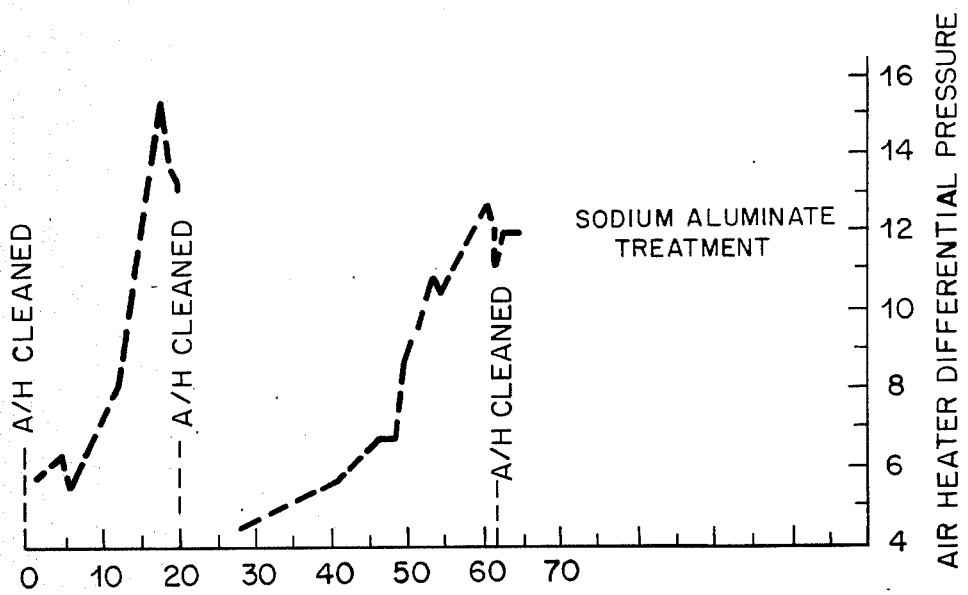

The process of the invention employing an aqueous composition including 10% by weight 7-pentyl-7-pentadecylammonium sulfate, 4% by weight alkyleneoxypolyethylenoxy ethanol [$C_{12}H_{29}O(CH_2CH_2O)_7CH_2CH_2OH$], was utilized to afford antifouling (and corrosion) protection to the air heaters on a 600 Megawatt Combustion Engineering Utility Boiler. This composition was supplied to the combustion gas-in side of the air heater at a rate of from 3 to 10 gallons/hour. A comparison was made between one air heater treated with the invention (FIG. 2*a*) and the same air heater treated with magnesium oxide powder (FIG. 2*b*) (a neutralizing inorganic powder treatment) at a rate of from 30 to 40 pounds/hour. Another comparison was made between one air heater treated with the invention (FIG. 3*a*) and another air heater treated with sodium aluminate (FIG. 3*b*) (a neutralizing inorganic powder treatment) at a rate of from 30 to 60 pounds/hour.

A practical measure of air heater fouling is the pressure differential across the air heater. The higher the pressure, the greater the fouling. When the pressure reaches a level where there is insufficient combustion air, the boiler is normally bought off line and the air heater is defouled.

With the above procedures, the air heater differential pressure was measured as a function of time. The graphical representation of the results are illustrated in FIGS. 2 and 3. "A/H CLEANED" indicates that the air heated was cleaned by conventional defouling techniques. As can be readily determined from these Figures, the process of the invention provides reduced pressure differential and therefore less fouling of the air heater.

It will be understood that the embodiments described above are merely exemplary and that person skilled in the art may make many variations and modifications without departing from the spirit and scope of the invention. All such modifications and variations are intended to be included within the scope of the invention as defined by the appended claims.

I claim:

1. A process for inhibiting corrosion of metal surfaces and minimizing deposits in an air preheater system in which said metal surfaces are to be contacted with hot combustion gases and heat exchange is to be carried out between a cool air stream and said hot combustion gases comprising the step of supplying with the air to be preheated to the air-in side of said air preheater system a composition comprising a corrosion inhibiting amine or amine-substituted compound and a surfactant whereby said metal surfaces of said air preheater are thereby coated with said composition when they are contacted with said hot combustion gases.

2. A process according to claim 1, wherein the HLB value of the surfactant is from about 10 to about 14.

3. A process according to claim 1, wherein the composition is an aqueous solution or dispersion.

4. A process according to claim 1, wherein the composition is supplied intermittently.

5. A process according to claim 1, wherein said composition is supplied to said air preheater via a soot blower.

6. A process according claim 1, wherein said corrosion inhibiting amine comprises a primary, secondary, or tertiary aliphatic or aromatic amine or derivatives thereof.

7. A process according to claim 1, wherein said surfactant is selected from the group consisting of alkanolamides, block copolymers of ethylene oxide and propylene oxide, ethoxylated alcohols, ethoxylated alkyl phenols and mixtures thereof.

8. A process according to claim 1, wherein said amine and surfactant are contained in said composition in a weight ratio of from about 20:1 to about 1:10, respectively.

9. A process according to claim 1, wherein said amine and surfactant are contained in said composition in a weight ratio from about 5:2 to about 1:3, respectively.

10. A process according to claim 1, wherein the composition comprises the amine and surfactant in a weight ratio of about 1:3 in an aqueous solution thereof.

11. A process according to claim 1, wherein said corrosion inhibiting amine is in the form of a salt.

12. A process according to claim 11, wherein the tertiary alkyl amine salt is selected from 7-pentyl-7-pentadecylammonium sulfate or 4-propyl-4-decylammonium sulfate.

13. A process according to claim 1, wherein said corrosion inhibiting amine is selected from the group consisting of amine oxides, imidazolines, tertiary alkyl amines, secondary alkyl amines, primary alkyl amines, and hydroxylated primary and secondary alkyl amines and mixtures thereof.

14. A process according to claim 13, wherein said corrosion inhibiting amine is in the form of a salt.

15. A process according to claim 13, where said corrosion inhibiting amine is selected from the group consisting of lauryl dimethyl amine oxide, and a $C_{12}$ to $C_{24}$ tertiary alkyl amine salt.

16. A process for inhibiting corrosion of metal surfaces and minimizing deposits in an air preheater system in which said metal surfaces are to be contacted with hot combustion gases and heat exchange is to be carried out between a cool air stream and said hot combustion gases comprising the step of supplying with the air to be preheated to the air-in side of said air preheater system a composition comprising a corrosion inhibiting amine or an amine-substituted compound whereby said metal surfaces of said air preheater are thereby coated with said composition when they are contacted with said hot combustion gases.

17. A process according to claim 16, wherein said composition is supplied intermittently.

18. A process according to claim 16, wherein said composition is supplied to said air preheater through a soot blower.

19. A process according to claim 16, wherein said corrosion inhibiting amine comprises a primary, secondary, or tertiary aliphatic or aromatic amine or derivatives thereof.

20. A process according to claim 16, wherein said corrosion inhibiting amine is selected from the group consisting of amine oxides, imidazolines, tertiary alkyl amines, secondary alkyl amines, primary alkyl amines, and hydroxylated primary and secondary alkyl amines and mixtures thereof.

21. A process according to claim 20, wherein said corrosion inhibiting amine is in the form of a salt.

22. A process according to claim 20, wherein said corrosion inhibiting amine is selected from the group consisting of lauryl dimethyl amine oxide and a $C_{12}$ to $C_{24}$ tertiary alkyl amine salt.

23. A process according to claim 16, wherein said corrosion inhibiting amine is in the form of a salt.

24. A process according to claim 23, wherein the tertiary alkyl amine salt is selected from 1-pentyl-1-hexylnonylammonium sulfate or 1,1-dipropylheptylammonium sulfate.

25. A process for inhibiting corrosion of metal surfaces and minimizing deposits in an air preheater system comprising the step of supplying to the air preheater system a composition comprising a corrosion inhibiting amine selected from the group consisting of lauryl dimethyl amine oxide, and a $C_{12}$ to $C_{24}$ tertiary alkyl amine salt and a surfactant having an HLB value of from about 8 to about 20.

26. A process for inhibiting corrosion of metal surfaces and minimizing deposits in an air preheater system comprising the step of supplying to the air preheater system a composition comprising a corrosion inhibiting amine in the form of a tertiary alkylamine salt selected from 7-pentyl-7-pentadecylammonium sulfate or 4-propyl-4-decylammonium surface and a surfactant having an HLB value of from about 8 to about 20.

27. A process for inhibiting corrosion of metal surfaces and minimizing deposits in an air preheater system comprising the step of supplying to the air preheater system a composition comprising a corrosion inhibiting amine and a surfactant having an HLB value of from about 8 to about 20 selected from the group consisting of alkanolamides, block copolymers of ethylene oxide and propylene oxide, ethoxylated alcohols, ethoxylated alkyl phenols and mixtures thereof.

* * * * *